US006087996A

United States Patent [19]

Dery

[11] Patent Number: 6,087,996

[45] **Date of Patent: *Jul. 11, 2000**

[54] THIN-FILM ANTENNA DEVICE FOR USE WITH REMOTE VEHICLE STARTING SYSTEMS

[75] Inventor: Normand Dery, Quebec, Canada

[73] Assignee: Astroflex Inc., St-Elie d'Orford, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,762

[22] Filed: Feb. 21, 1997

[30] Foreign Application Priority Data

Feb. 18, 1997 [CA] Canada ..... 2197828

[51] Int. Cl.[7] ..... H01Q 1/32

[52] U.S. Cl. ..... 343/713; 343/700 MS

[58] Field of Search ..... 343/713, 711, 343/700 MS, 872; H01Q 1/32

[56] References Cited

U.S. PATENT DOCUMENTS

| | | | |
|---|---|---|---|
| 2,774,811 | 12/1956 | Shanok et al. | 343/711 |
| 3,634,864 | 1/1972 | Trachtenberg | 343/713 |
| 3,646,561 | 2/1972 | Clarke | 343/713 |
| 4,132,994 | 1/1979 | Caldwell | 343/713 |
| 4,180,711 | 12/1979 | Hirata et al. | 200/5 A |
| 5,363,114 | 11/1994 | Shoemaker | 343/713 |
| 5,448,110 | 9/1995 | Tuttle et al. | 257/723 |
| 5,453,751 | 9/1995 | Tsukamoto et al. | 343/700 MS |
| 5,528,314 | 6/1996 | Nagy et al. | 343/713 |
| 5,574,470 | 11/1996 | De Vall | 343/872 |

*Primary Examiner*—Hoanganh Le
*Assistant Examiner*—Hoang Nguyen
*Attorney, Agent, or Firm*—Ladas & Parry

[57] ABSTRACT

The present invention relates to a thin-film antenna device particularly well suited for use with remote vehicle starting systems. The antenna device includes an electrically conducting film printed on an insulating substrate that can be bonded to any suitable supporting surface, such as the windshield of a vehicle. The electrically conductive film is protected by an outer protective coating along its entire surface except at two areas that form contact pads for receiving the terminals of a signal processing unit such as a radio receiver, demodulator, filter and amplifier, among many others. The signal processing unit is mounted to the same surface to which the antenna device is secured by a releasable attachment system such as a hook and loop type fastener. In a typical installation, a patch of hook-type material is adhesively bonded to the supporting surface overlying the antenna device. The patch of hook-type material includes a pair of apertures registering with the contact pads of the antenna device. The signal processing unit includes a printed circuit board to which is bonded a patch of loop-type material. A pair of resilient three-dimensional contact elements project through the loop-type material patch such that when the two patches are mated the contact elements pass through the apertures of the hook-type material patch and engage the contact pads of the antenna device.

19 Claims, 5 Drawing Sheets

THIN-FILM ANTENNA DEVICE FOR USE WITH REMOTE VEHICLE STARTING SYSTEMS

FIELD OF THE INVENTION

The invention relates to a novel antenna device well suited for use with systems for remotely operating selected components of a vehicle, such as starting the engine at a distance. The antenna device can be of a monopole or a dipole configuration and can include embedded circuit elements for impedance matching (tuning) purposes for example. The invention also extends to a combination antenna and signal processing circuit that can be easily mounted to a supporting surface such as the windshield of the vehicle. The invention further comprehends a novel device for connecting electrical components using a resilient three-dimensional contact element.

BACKGROUND OF THE INVENTION

Remote vehicle starting systems are widely available in the North-American continent particularly in those areas where the climate is harsh during the winter season. A typical remote vehicle starting system includes a hand-held transmitter with a simple key pad structure that allows the owner of a vehicle to remotely start the engine by depressing the appropriate key. The hand-held transmitter generates a low power radio frequency (RF) signal received by a controller mounted in the vehicle. Once a valid engine start command is recognized the controller energises the starter motor, ignition and fuel supply systems so the engine can be started without any human intervention. To enhance the functionality of such remote vehicle starting systems manufacturers have also built in those devices additional features such as the ability to control the door locks remotely, raise or lower the windows, operate the trunk release lock and activate/deactivate the alarm system of the vehicle, among others. To operate a selected component of the vehicle, the owner must depress a specific key or a combination of keys on the keypad that is unique.

To enable a reliable radio communication between the hand-held transmitter and the controller on board the vehicle, a suitable antenna must be installed on the vehicle. The antenna of a remote vehicle starting system is usually mounted inside the vehicle, at some appropriate location in the cabin. Although installing the antenna outside is possible, such procedure is not preferred for practical reasons. Indeed, if the antenna is connected to a body panel such as the fender or trunk a suitable pathway must be provided to route the antenna cable toward the receiver. Such pathway is difficult to find or create particularly because vehicle manufacturers design automobiles with cabins that are very well isolated from the external environment and in most cases apertures allowing the passage of the antenna cable are nonexistent. Drilling a hole in the body panel to accommodate the antenna cable is of course possible, however, such procedure is objectionable because it creates a permanent alteration to the body panel and increases the risk of corrosion. A different possibility is to use antennas developed for cellular telephony applications that mount to a glass surface and connect with a cable, located in the cabin through a capacitive coupling established through the glass material. This solution is not optimal, however, because the capacitive coupling significantly weakens the radio signal.

A typical internally mounted antenna for a remote vehicle starting system includes a pair of relatively rigid rod-like conductors that project from a housing of plastics material where is placed the demodulator circuit, constructed as a small printed circuit board. The back surface of the housing is provided with an adhesive surface so it can be securely mounted to any appropriate location, such as the inner surface of the windshield.

Two distinct drawbacks exist with this approach. First, the antenna device, constituted by the pair of rigid conductors is not physically separable from the receiver section which means that if one component, either the antenna device or the demodulator fails, the entire unit must be replaced. Second, the antenna/demodulator unit is quite bulky and may not be aesthetically pleasant to the eye.

OBJECTIVE AND STATEMENT OF THE INVENTION

An object of the invention is a novel antenna device, particularly well suited for use with systems for remotely operating selected components of a vehicle, such as starting the engine at a distance, that is of low profile and can be easily mounted to an appropriate supporting surface such as the windshield of the vehicle.

Another object of the invention is a novel antenna device and signal processing unit combination, particularly well suited for use with systems for remotely operating selected components of a vehicle, where the signal processing unit can be easily separated from the antenna device for service or replacement.

Yet, another object of the invention is a signal processing unit, particularly well suited for use with systems for remotely operating selected components of a vehicle, with an electric terminal configuration providing easy connection with an antenna device.

A further object of the present invention is a novel device for connecting electrical components using a resilient three-dimensional contact element.

As embodied and broadly described herein, the invention provides a thin-film, laminated antenna device for sensing radio frequency signals, said antenna device comprising:

- an elongated strip of insulating material constituting a substrate, said substrate including a pair of main opposite faces, one of said faces being capable of being bonded to a supporting surface;
- an electrically conductive pathway laid at least in part on one of said faces, said electrically conductive pathway and said substrate being flexible to allow conformation of said antenna device against a curved supporting surface to which said antenna device may be mounted;
- at least one exposed terminal mounted on said substrate enabling electrical connection of said electrically conductive pathway with a signal processing unit.

In a most preferred embodiment the substrate is an elongated polyester strip on which is screen printed a thin conductive film to form the electrically conductive pathway. The material of choice for creating the conductive film is an ink formulation containing silver particles suspended in a suitable carrier. The conductive ink deposition, once cured is covered with a protective coating made of insulating material. Most preferably the protective coating is an ultraviolet curable polymeric coating constituting a dielectric shield that also provides mechanical protection of the conductive film. Advantageously, the conductive ink is deposited on the surface of the substrate opposite the surface that bonds with the supporting surface such as the windshield of a vehicle. This configuration is practical because the terminals that serve to connect the antenna to radio receiver circuit are created on the same face of the substrate as the conductive pathway. In should be noted, however, that the opposite arrangement is also possible, where the conductive pathway is deposited on the surface of the substrate that bonds with the supporting surface (windshield). Objectively, this arrangement is less desirable because it is more difficult to manufacture and perhaps install. On the other hand it results in a very robust antenna device where the conductive pathway is encapsulated between the supporting surface (windshield) and the polyester substrate.

The ability of the antenna device to conform to curved supporting surfaces is an important aspect of the invention, and consequently the ability of the materials constituting the laminated antenna structure, particularly the conductive ink and the protective coating to flex within certain limits without cracking, flaking, peeling or otherwise degrading is important. Indeed, the ink formulation should be selected to create a flexible conductive film, that when subjected to bending still meets certain electrical properties, such as continuity of the electrical path and small resistance. It should be appreciated that if the conductive film is subjected to cracking or its resistance substantially increases when it is flexed, the antenna may no longer operate at all or operate poorly because its electrical properties have changed. Similarly, the protective coating also needs to be flexure resistant. Otherwise, it may locally crack leaving the conductive film underneath exposed. Objectively, should the protective coating peel or otherwise be removed because of bending, this does not imply that the antenna will no longer function. It only means that the dielectric and mechanical shield over the conductive film will be compromised which may shorten the useful life of the antenna device. Thus, the requirement of flexure resistance is more important toward the conductive film than the protective coating that can to some extent tolerate bending induced flaws without seriously compromising the functionality of the antenna device.

In practice, the degree of flexing that needs to be tolerated by the conductive ink and the protective coating before creating any permanent and serious damage needs not be very great. Suffice it to say that the antenna device should be able to retain its electrical and mechanical properties when caused to conform to a slightly curved surface, such as the windshield of a vehicle.

Most preferably, to connect the antenna device with a signal processing unit such as a radio receiver, a small portion of the conductive film is masked during the application of the protective coating so it remains free of dielectric material. The exposed portion of the conductive film is then encapsulated with carbon ink which is a composition including carbon particles suspended in a suitable carrier. Once the carbon ink is cured, it forms a conductive site, electrically linked with the underlying conductive film. Such conductive site is mechanically resistant and forms a contact pad for receiving a mating contact element of the signal processing circuit.

To mount the antenna to a supporting surface, such as the windshield of a vehicle, the surface of the polyester substrate opposite the one that carries the conductive film is preferably coated with positioning adhesive. The adhesive may be applied as a series of continuous or discontinuous areas as is needed, a continuous coating being preferred to provide a strong bond and good resistance to edge lifting. To protect the adhesive during shipping and storage of the antenna device, the adhesive is covered with silicone coated release paper that must be peeled off before installation.

When the antenna device in accordance with the invention is designed in a dipole configuration the insulating substrate is configured to carry a pair of co-linear conductive film extending away from another, each film forming one element of the dipole. The central portion of the antenna device includes a pair of carbon ink contact pads, one pad associated with each conductive film. Designing the antenna device differently is also possible, such as a monopole, among others.

To enhance the functionality of the antenna device passive circuit elements can be created on the substrate to allow some degree of signal conditioning without the necessity of external components. Such signal conditioning can be used to change the impedance of the antenna, for example. The circuit elements, such as capacitors, inductors or transformers are created during the deposition of the conductive film simply by controlling the ink deposition pattern. To create a capacitor, for example, is suffices to lay two ink traces on either side of the substrate and in overlapping relationship with one another, each trace forming one of the capacitor plates while the substrate medium forms the dielectric layer. The value of the capacitor is determined by the spacing of the plates, their surface and the dielectric constant of the medium between the plates. Another possibility is lay multiple layers of protective coating to form the capacitor, rather than placing the conductive traces on either side of the substrate. Under this form of construction, the conductive ink forming one capacitor plate is deposited on the substrate and then covered by the protective layer. When the protective layer has cured, a second ink deposition is made to overlie the first one and thus form the second capacitor plate. Finally, a second protective layer is deposited to cover the exposed conductive ink trace. The advantage of this arrangement resides in the ability to create a relatively elevated capacitance by virtue of the thin dielectric layer between the plates. On the other hand, a more complex manufacturing procedure is required to build the antenna.

To create an inductor, the ink may be deposed according to an undulating pattern to form the equivalent of coils that build-up a magnetic field during the passage of electrical current. A transformer can be formed by creating a pair of inductors, electrically isolated but physically close to establish between them a magnetic coupling.

It is of course possible to form on the insulating substrate several different components connected to make a circuit. A typical example is as a filter that attenuates signals outside the frequency range in which the antenna device is designed to operate.

As embodied and broadly described herein the invention also provides a thin-film, laminated antenna device for sensing radio frequency signals, said antenna device comprising:

a first layer including an electrically conductive pathway;

a second layer of dielectric material overlaying said first layer;

said electrically conductive pathway including at least one exposed terminal for electrical connection with a signal processing device;

said antenna device including a face capable of being bonded to a supporting surface; and said first and second layers being flexible to allow conformation of said antenna device against a curved supporting surface to which said antenna device may be mounted.

This form of construction of the antenna differs from the previously described embodiment in that the insulating substrate is no longer used. Most preferably, the conductive film and protective coating laminate are coated with adhesive that bonds the laminate to the supporting surface such as the windshield of the vehicle. Objectively, this form of construction is not optimal because the conductive film/protective coating laminate, in the absence of the insulating substrate is structurally very weak and it is thus difficult to handle during the various steps of the manufacturing process, shipping and installation.

It should be noted that the use of the antenna device in accordance with the invention, under the various forms of construction described above is not limited to remote vehicle starting systems only. The antenna can also be employed for cellular telephony applications, alarm systems and two-way radios, among other communication systems.

As embodied and broadly described herein, the invention further provides a device for connecting electrical components, comprising:

a support element including an electrically conductive surface;

a three-dimensional resilient contact element, including:

a) a core that is substantially non-conductive and resilient;

b) a layer of flexible electrically conductive film at least partially surrounding said core, said film including a first surface that is exposed and capable of establishing an electrical contact with a given external component to allow passage of electrical current between said electrically conductive surface and the given component, and a second surface in electrical contact with said electrically conductive surface, said film of flexible electrically conductive material extending between said first and second surfaces to establish an electrically conductive pathway therebetween.

The device for connecting electrical components, as defined above is well suited for electrically linking two components, such as an antenna and a signal processing unit, to effect transfer of electrical current (signal) between them. Most preferably, the signal processing device includes a printed circuit board containing the components forming the signal processing circuitry. The three-dimensional resilient contact element includes a core made of synthetic foam wrapped in a sheath of metallized fabric that is electrically conductive. The sheath of metallized fabric is bonded to an electrically conductive surface formed on the printed circuit board by conductive adhesive. Note that the metallized fabric does not need to encircle the core completely. It suffices to provide at least two conductive faces, one face to establish a contact with the external component, say the antenna device, one face to connect with the electrically conductive surface on the printed circuit board and a conductive pathway between the two surfaces.

The ability of the core to compress and recover its original configuration when the deformation effort ceases, combined to the flexibility of the electrically conductive film, allow the contact element to mate with an external component and establish a stable low-impedance electrical contact therewith within an appreciable range of distances between the signal processing device and the external component. This means that misalignments and slight variations of the nominal distance between the signal processing device and the external component can be tolerated without degrading the quality or reliability of the electrical connection.

As previously mentioned the flexible film surrounding the foam core is a metallized fabric. This, however, is not an essential element of the invention as other possibilities exist. For example it is conceivable to use a thin metallic foil or a fabric woven entirely or partially from conductive strands. Metallized fabric is preferred however due to its durability and low cost.

The signal processing device is particularly well suited for use with the antenna device previously described. Preferably, the signal processing device is mounted on the same supporting surface (the windshield, for example), straddling the laminated antenna structure. The signal processing device is attached to the windshield by a releasable fastener, such as a hook and loop type attachment system. A patch of hook type material is bonded to the housing of the signal processing device, with suitable apertures to allow the passage of two resilient contact elements. A patch of loop type material with apertures registering with the resilient contact elements bonds to the windshield such as the apertures line-up with the contact pads of the antenna device. The patches of hook and loop type material are then mated, the resilient contact elements touching the contact pads through the apertures in the hook and loop type layers of material. Once in a condition of engagement the hook and loop type layers maintain the resilient contact elements in a slightly compressed condition to establish a positive contact with the contact pads of the antenna device. The resulting structure allows the signal processing device to be reliably connected to the antenna device and at the same time it can be easily removed from the windshield by separating the hook and loop type layers, without the necessity of cutting any wires.

As embodied and broadly described herein, the invention further provides an electrical connection device for mounting to a substantially rigid supporting surface, said electrical connection device including:

a first mounting pad capable of being mounted to the substantially rigid supporting surface;

a second mounting pad;

an electrically conductive surface mounted to said second mounting pad, said second mounting pad bing capable of establishing a releasable connection with said first mounting pad to retain said electrically conductive surface and said second mounting pad to the supporting surface;

a resilient contact element for providing a conductive pathway between said electrically conductive surface and a contact pad retained to the supporting surface, said resilient contact element being compressed when said second mounting pad established a connection with said first mounting pad to allow and maintain transmission of electrical current between said electrically conductive surface and the contact pad retained on the supporting surface in the event of small misalignment or displacement between said first and second mounting pads.

The above defined general purpose connection device allows to establish a reliable and robust electrical connection over a supporting surface, such as the window of a vehicle cabin. Note that the resilient contact elements need not be constructed according to the elaborate manner earlier described. Any type of contact element that is resiliency deformable and at the same time provides a conductive pathway could be used. The contact element may be integrally formed or made as a compound structure. A typical example could be a coil spring that can compress to resiliency engage a contact pad and at the same time provide an electrical conductor. This type of connection device could be used for signal transmission purposes between an antenna and a signal processing unit or to supply electrical energy to a load such as a conductive defrosting array embedded or laid on the surface of a window for melting away snow and ice.

Preferably the first mounting pad is a patch of Velcro type material that has an adhesive surface allowing the patch to be bonded to the supporting surface. The patch can be configured to expose contact pads or other electrically conducting structures with which contact is to be established. The second mounting pad, also a patch of Velcro type material is retained, preferably by adhesive, to the electrically conducting surface. That electrically conducting surface, could be connected to an electric cable or be formed over a printed circuit board carrying a signal processing or any other type of circuitry. Thus, the second mounting pad, when connected to the first mounting pad would also attach the electrically conducting surface and any other component retained to it to the supporting surface. The resilient element extending between the contact pad on the supporting surface and the electrically conducting surface may be physically retained to either one of these components. Most preferably, the resilient contact element is retrained to the electrically conducting surface.

As embodied and broadly described herein the invention further provides an antenna device capable of being bonded to a supporting surface, said antenna device including:

at least one exposed terminal;

a signal processing device for connection with said antenna device, said signal processing device including:

a) a support element including an electrically conductive surface;

b) a circuit capable of processing a signal impressed at said electrically conductive surface;

c) a three-dimensional resilient contact element; and fastening means allowing to mount said support element to the supporting surface and cause said three-dimensional resilient contact element to physically engage said exposed terminal.

The fastening means may be any kind of agency that will adequately retain the support element to the supporting surface. For example, the fastening means may be a hook and loop type fastening system, an adhesive connection, one or more mechanical fasteners (such as screws, bolts or clips for example), any kind of mechanical interlocking between the support element and the supporting surface (which includes frictional affixation) and electrostatic bond, among other possibilities.

DESCRIPTION OF THE PREFERRED EMBODIMENTS

Figure 1:
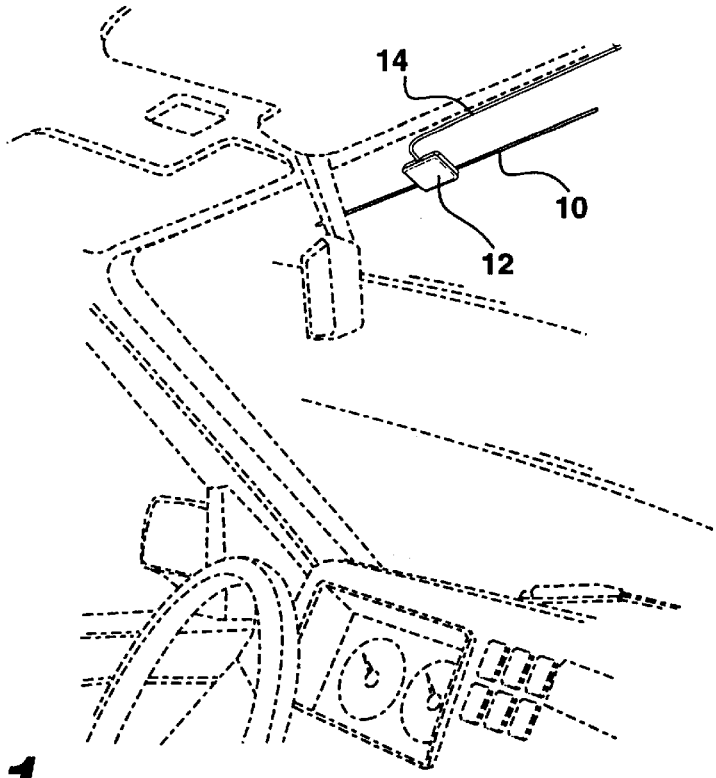
FIG. 1 is a perspective view of the forward section of a vehicle cabin illustrating the approximate location of the thin-film antenna and receiver circuit combination constructed in accordance with the present invention, when used in a remote vehicle starting system.
Figure 2:
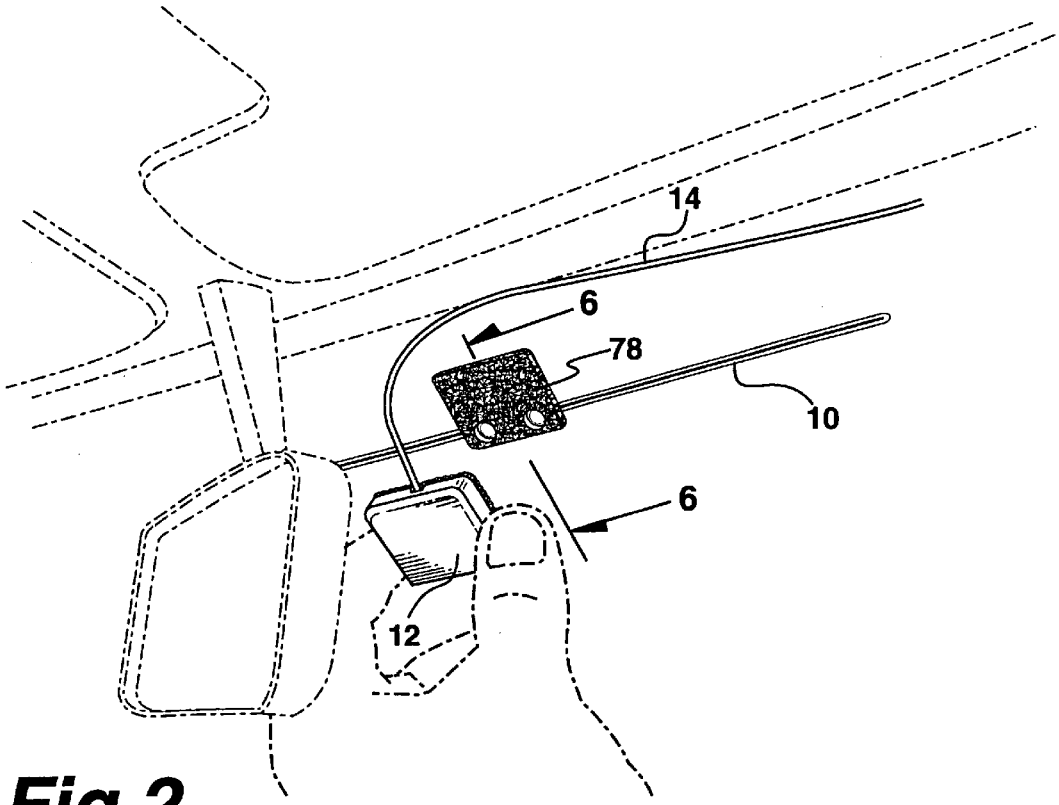
FIG. 2 is an enlarged view of the thin-film antenna and receiver circuit combination illustrating the receiver circuit separated from the windshield surface to which it is normally mounted.

FIG. 1 of the annexed drawings illustrates the receiver section of a remote vehicle starting system. The receiver section includes two main components namely a thin-film antenna 10 and a signal processing device 12 that is electrically connected to the antenna 10 to process the electrical signals therefrom. Typically, the signal processing device 12 a signal which is directed to a controller unit (not shown in the drawings) through a cable 14. Both components of the receiver section are mounted to the inner surface of the windshield of the vehicle. The electrical connection between the thin-film antenna 10 and the receiver 12 is such as to allow the receiver to be removed from the windshield, for inspection and service. The electrical connection does not require any wire soldering or crimping. At the same time it is reliable, stable and allows to establish a low impedance electrical path between the antenna and the receiver.

Figure 4A:
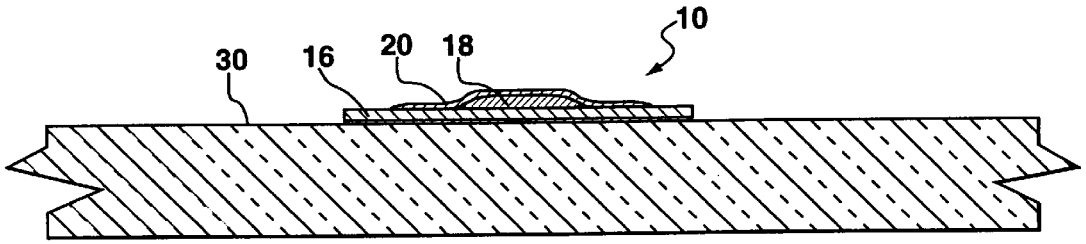
FIG. 4*a* is an enlarged cross-sectional view taken along lines 4*a*—4*a* in FIG. 3.

The structure of the thin-film antenna 10 will now be described in detail in connection with FIGS. 4*a,* 4*b* and 4*c*. The antenna 10 is a laminated structure including a substrate 16 that constitutes a base on which are built-up a conductive layer and a protective layer that by themselves have a limited mechanical resistance. The substrate 16 is made of polyester film that is transparent and has the ability to flex without cracking. The polyester material is also dielectric which shields the conductors of the antenna from any metallic element that may contact the substrate 10. Polyester film available from the AUTOTYPE U.S. company under the trade designation Autostat CT5 has been found satisfactory. On the upper surface of the polyester substrate 16 is deposited by screen printing a pair of conductive films 18. The ink formulation for creating the conducting films is a polymeric composition containing silver particles. The ink formulation available from the DuPont company under the trade designation 5025 Silver Conductor has been found satisfactory.

The conductive films 18 are covered by respective protective dielectric layers 20 that provide the desired degree of mechanical and electrical shielding. The protective layers 20 are applied by screen printing. The ultraviolet curable dielectric coating available from the Acheson Colloids company in the United-States under the trade designation UL25208 has been found satisfactory.

The protective layers 20 are applied over the entire surface of the conductive films 18 except at the locations 22 and 24 where the conductive films are left exposed. (this feature can be seen only in FIG. 4*c*). The exposed areas of the conductive films 18 are encapsulated with a layer of material containing carbon particles that donate conductivity. That layer is also applied by screen printing. The ink formulation that has been found satisfactory is available from the DuPont company under the trade designation 7861D Carbon Conductor. When the carbon particles containing ink is cured it forms a pair of exposed contact pads 26 and 28 that are in electrical contact with the respective conductive films 18.

The thin-film antenna device 10 can be bonded to the inner surface of the windshield 30 by any suitable adhesive. Most preferably, the lower surface of the polyester substrate 16 (the surface opposite the conductive films 18 is coated with positioning adhesive. The coating pattern can vary without departing from the spirit of the invention, a continuous coat over the entire lower surface of the polyester substrate 16 being preferred. The adhesive selected should be sufficiently resistant to provide a secure bond and high edge lifting resistance. To protect the adhesive during shipping and storage of the antenna device, a silicone coated release paper(not shown in the drawings) should be applied over the adhesive coated surface of the polyester substrate 16. This release paper must be removed prior the installation to expose the adhesive and allow the antenna device 10 to be mounted to the appropriate supporting surface, such as the inner surface of the windshield 30.

During the application of the thin-film antenna device 10 to the windshield 30 the antenna is slightly flexed when it is caused to conform to the curvature of the windshield that is normally present in almost any model of automobile available today. The materials from which the various layers of the antenna device 10 are made should be selected to withstand bending without cracking or peeling. This is particularly important for the conductive films 10 that should be able to provide a continuous electrical path at every point of their length after they have been bent. Another important parameter is the impedance of the conductive films that should not substantially increase after the antenna device 10 is bended. It will be appreciated that if the impedance of one or of both films 10 significantly changes after the antenna is bent while conforming to the surface of the windshield the performance of the antenna may suffer. As previously discussed in somewhat greater detail the degree of flexing that the antenna needs to tolerate before suffering any damage or degradation needs not be very great. Suffice it to say that the antenna device should be able to retain its electrical and mechanical properties when caused to conform to a slightly curved surface, such as the windshield of a vehicle.

Figure 4B:
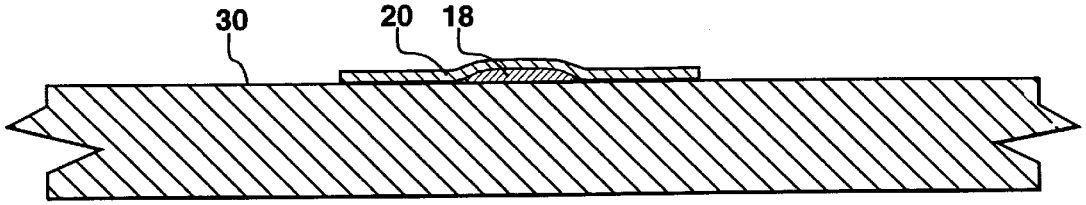
FIG. 4*b* is similar to FIG. 4*a* and shows a variant of the thin-film antenna device.

A variant of the thin-film antenna device 10 is illustrated in FIG. 4*b*. In this embodiment the antenna has no longer any polyester substrate 16, the windshield itself providing the supporting function for the conductive films 18 and the protective layer 20. To bond the antenna device to the windshield an adhesive coating is applied on the lower surface of the conductive films 18 and on the surfaces of the protective layer 20 that project laterally beyond the conductive films 18. This mode of execution, however, is less advantageous than the previous embodiment because the absence of the polyester substrate 16 renders the manufacture and subsequent manipulation of the antenna device prior its installation on the windshield 30 complex and delicate. Indeed, the conductive films 18 and the protective layer 20 have only a limited mechanical resistance and may easily brake or tear when no substrate is present.

In a different embodiment, the conductive films 18 and the adhesive layer may be applied on the same surface of the polyester substrate. More specifically, the conductive films are deposited first, following by the application of the adhesive. Ideally, the adhesive chosen for this application should be highly dielectric so as to provide a high impedance between the conductive films. If a high impedance adhesive layer is not desirable it is always possible to apply over the conductive films the UV curable protective coating that serves as a basis to lay the adhesive layer. This antenna construction features excellent mechanical resistance because the conductive films that are the most critical and fragile components are encapsulated between the glass material to which the substrate is bonded and the substrate itself.

Figure 3:
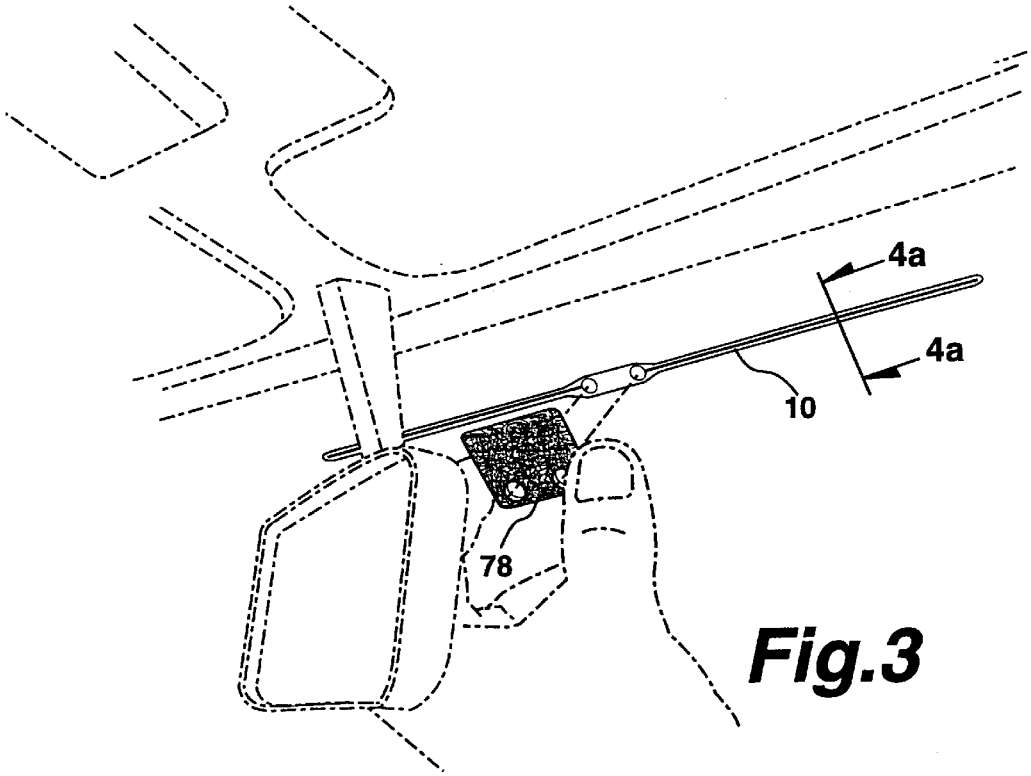
FIG. 3 is similar to FIG. 2 with the exception that the receiver circuit has been omitted allowing to illustrate the process for bonding a Velcro type attachment system to the windshield surface.
Figure 4C:
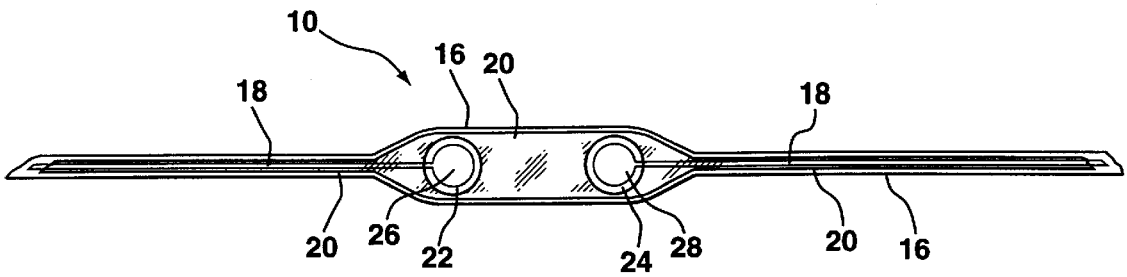
FIG. 4*c* is a fragmentary enlarged top plan view of the thin-film antenna device shown in FIG. 4*a;*
Figure 4D:
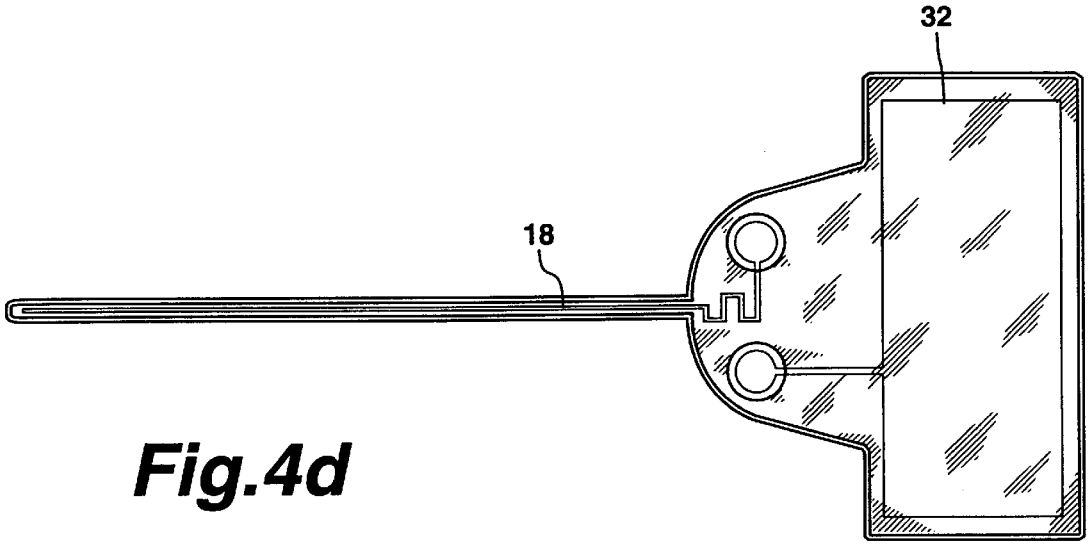
FIG. 4*d* is a top plan view of a thin-film antenna in accordance with the invention in a monopole configuration.

The antenna device 10 illustrated in FIG. 3 and in FIG. 4*c* is of a dipole configuration. It is also possible to realize a monopole antenna, as shown in FIG. 4*d* without departing from the spirit of the invention. In this embodiment, the antenna device includes an elongated conductor film 18 acting as one part of a dipole whose other part is formed by its electrical image in the ground plane 32. The ground plane 32 is created in a similar manner to the conductive films 18, that is, by printing a comparatively large surface of the polyester substrate 16' with a conductive ink composition.

Figure 4E:
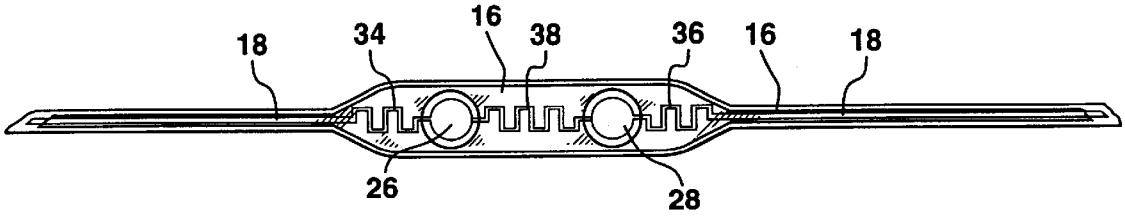
FIG. 4*e* is a top plan view of the thin-film antenna with embedded inductor components.

To enhance the functionally of the thin-film antenna device 10 passive electrical components, such as capacitors, inductors or a transformer can be embedded in the conductive path formed by the ink impression. FIG. 4*e* of the drawings illustrates an embodiment of the antenna device where 3 inductor elements have been inserted in the electrical circuit. More specifically, inductor elements 34 and 36 are placed in series with the respective conductive films 18. A third inductor 38 is connected across the external connection pads 26 and 28. As it will be apparent to a person skilled in the art, the trio of inductors can be used to fine tune the antenna impedance. The inductors are formed at the same time the conductive films 18 are deposited on the polyester substrate 16. It suffices to design the mask for performing the screen printing such as to lay on the polyester substrate 16 traces of conductive ink extending along an undulating path that behaves as coils.

Figure 4F:
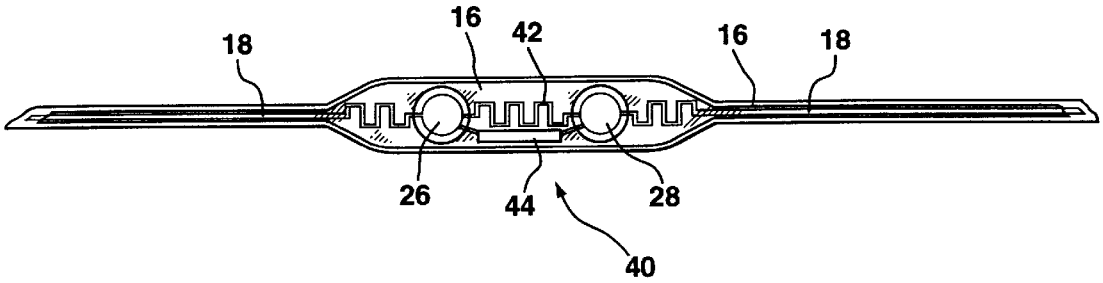
FIG. 4*f* is a top plan view of the thin-film antenna with embedded inductor and capacitor components.

A similar concept can be used to create a capacitor element as shown in FIG. 4F of the drawings. The capacitor element 40 comprises a pair of fine conductive films traces 42 and 44 electrically connected to respective conductor films 18. The film traces 42 and 44 form respective plates of the capacitor element 40. To provide a relatively elevated capacitance, the film traces 42 and 44 overlie one another and are separated by a dielectric medium. One way to construct the assembly is to deposit one conductive film over the outer surface of the substrate and then cover the film trace associated with the deposited conductive film with electrically insulating material such as the UV curable coating. The second conductive film and the associated trace is then deposited on the substrate, the second film trace overlying the cured coating patch. Thus, the coating patch forms the dielectric medium between the capacitor plates. The circuit shown at FIG. 4F constitutes a filter allowing to attenuate unwanted frequencies.

Figure 4G:
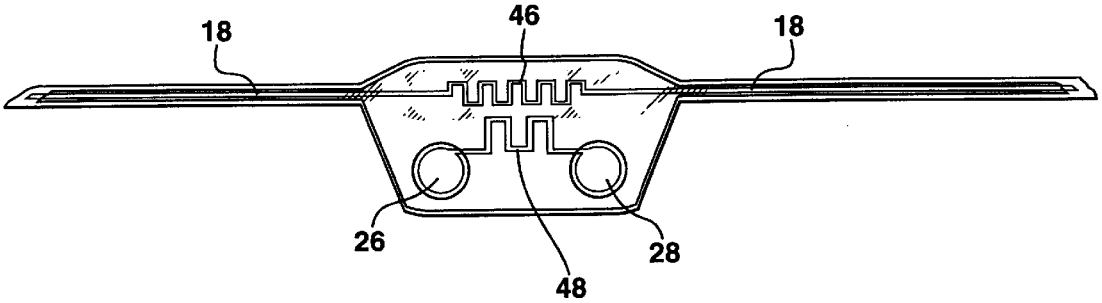
FIG. 4*g* is a top plan view of the thin-film antenna with an embedded transformer component.

A further embodiment of the antenna device is shown at FIG. 4G. Under this variant a transformer circuit is integrated to the antenna. The transformer circuit includes a first coil member 46 connected across the conductive films 18 and constituting the primary winding of the transformer. The secondary winding is formed by the inductor element 48 connected across the terminals 26 and 28. The inductor elements 46 and 48 are physically close to one another to establish a magnetic coupling between them. A transformer circuit of the type shown at FIG. 4*g* can be used to reduce the impedance of the antenna.

Figure 4H:
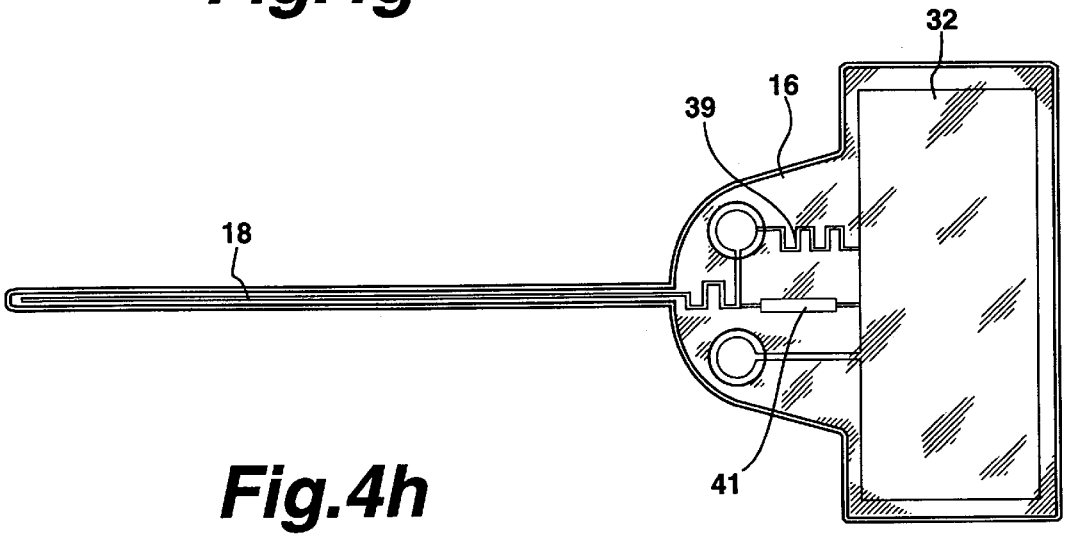
FIG. 4*h* is a top plan view of the thin-film antenna with embedded circuit elements forming a resonant circuit.
Figure 5:
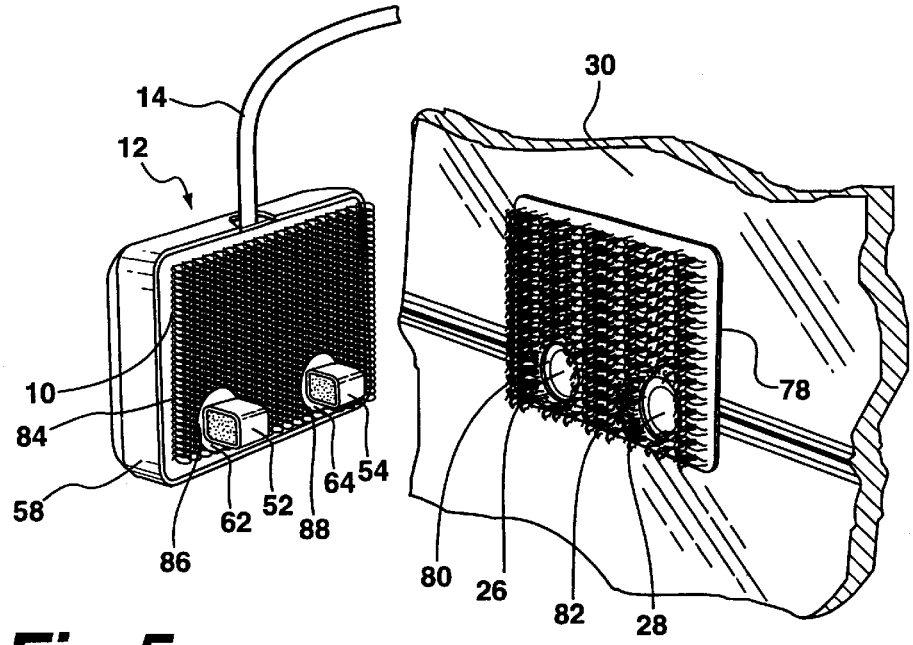
FIG. 5 is a fragmentary perspective view illustrating the receiver circuit and the Velcro type attachment system for affixing the circuit to the windshield surface.
Figure 6:
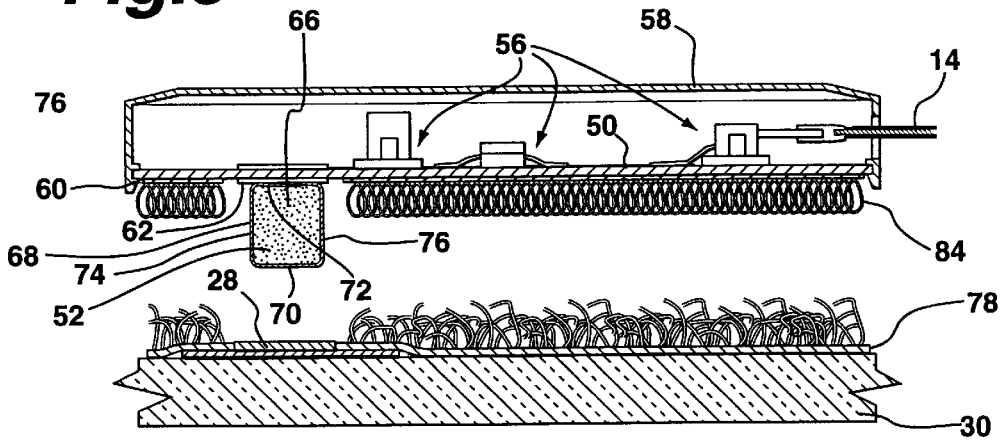
FIG. 6 is a somewhat enlarged cross-sectional view illustrating the receiver circuit, a three-dimensional contact element and the Velcro type attachment system for mounting the receiver circuit to the windshield surface. In this drawing the receiver circuit is shown separated from the windshield surface.

It will be apparent that the circuit elements which can be integrated to the antenna can vary greatly in accordance with the intended application. Those circuit elements can be used to change the impedance of the antenna or create filters such as band-pass filters to reject signals outside a certain frequency range, among many other possibilities. A specific example is shown at FIG. 4*h,* where a monopole antenna is provided with a resonant circuit, including an inductor 39 and a capacitor 41.

The receiver 12 will now be described in detail in connection with FIGS. 2, 5, 6 and 7 of the drawings. The receiver includes a printed circuit board 50 that constitutes a supporting element for a pair of three-dimensional resilient contact elements 52 and 54 designed to physically engage the connection pads 26 and 28 of the antenna device. The printed circuit board 50 also supports a variety of electrical components designated comprehensively by the reference numeral 56 in FIGS. 6 and 7. Typically, those components are electrically connected to the three-dimensional contact elements 52 and 54 and are designed to process or condition the signals received from the antenna. The so processed or conditioned signal is then transmitted to a control unit (not shown in the drawings) on the cable 14. The structure and organization of the various electrical components 56 will not be described in detail since this aspect of the receiver 12 does not form part of the invention.

The printed circuit board 50 is mounted in a housing 58 made of any suitable plastics material to provide protection for the components 56. The housing 58 is designed as a cup-shaped structure including on its inner surface a continuous groove 60 having the thickness corresponding to the thickness of the printed circuit board 50. The latter is mounted in the housing 58 by snap fitting it in the groove 60. The lower face of the printed circuit board 50 (the surface which is exposed) is provided with a pair of electrically conductive surfaces 62 and 64 that connect internally with the components 56. Those electrically conductive surfaces are created at the same time as the other conductive pathways on the printed circuit board 50. The three-dimensional resilient contact elements 52 and 54 are connected to respective conductive surfaces 62 and 64. Each resilient contact element comprises a core of non-conductive polymeric foam 66 which is resilient and once compressed can quickly return to its original configuration once the deformation effort applied to it ceases. The core 66 is wrapped by a flexible metallized fabric 68 that provides an outer conductive surface. It should be noted that the use of metallized fabric is not an essential element of the invention as other possibilities exist. For example it is conceivable to use a thin metallic foil or a fabric woven entirely or partially from conductive strands. What is required is a flexible film having the ability to conduct electricity. Metallized fabric is preferred, however, due to its durability and low cost.

The metallized fabric 68 has a frontal face 70 that is designed to physically contact a connection pad of the thin-film antenna device 10. The rear surface 72 of the fabric which is opposite to the frontal face 70 is bonded by conducting adhesive to one of the electrically conductive surfaces on the printed circuit board. The side surfaces 74 and 76 of the metallized fabric wrap establish an electrical path between the frontal face 70 and the rear surface 72. Thus, electrical current injected through the surface 70 will be transmitted through both side surfaces 74 and 76 to the rear surface 72 where it propagates to the electrically conductive surface (either 62 or 64) through the electrically conductive adhesive.

Each three-dimensional resilient contact element has a square cross-sectional shape, each side of the square having a dimension of approximately five millimeters. A convenient source for such resilient contact element is an electromagnetic interference shielding gasket manufactured by the Schlegel company in the United-States and available under the code E1417DXXXX where "XXXX" is the length of the gasket strip in inches. To manufacture the resilient contact element it suffices to transversely cut the gasket strip at the desired length and to bond the slices to the electrically conductive surfaces 62 and 64. Note that the gasket is already coated with conductive adhesive on the face 72 so no additional adhesive application step is required.

Note that other types of resilient three-dimensional contact elements may be used such as simple coil springs retained to the electrically conductive surfaces.

Figure 7:
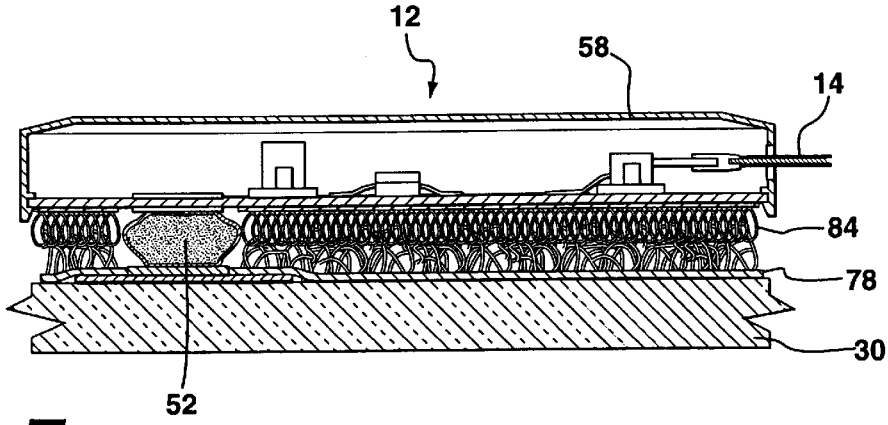
FIG. 7 is similar to FIG. 6 except that it shows the receiver circuit affixed to the windshield surface, the three-dimensional contact element physically engaging an exposed terminal of the thin-film antenna device.

To releasably retain the printed circuit board 50 to the windshield surface 30 a Velcro type attachment system is used. More specifically the attachment system includes a patch 78 of hook-type material that can be bonded with suitable adhesive to the windshield, the patch 78 including a pair of apertures 80 and 82 that are dimensioned and positioned to register with the connection pads 26 and 28. The patch 84 of loop-type material having the same dimensions as the patch of hook-type material is bonded to the lower surface of the printed circuit board 50. The patch 84 also includes a pair of apertures 86 and 88 to accommodate the resilient contact elements 52 and 54. To connect the receiver 12 to the windshield 30 it suffices to mate the patches forming the Velcro fastener such that the resilient contact elements physically engage the contact pads 26 and 28 of the antenna device. FIG. 7 illustrates the receiver 12 connected to the windshield 30. It will be appreciated that the resilient contact elements 52 and 54 are slightly compressed thus in firm contact with the connection pads. This enables to create a positive, stable, reliable and low impedance connection for efficient transfer of electrical signals from the antenna to the receiver. The three-dimensional resilient contact elements 52 and 54 are particularly advantageous because they allow to compensate for small variations particularly in the distance between the printed circuit board 50 and the windshield surface once the Velcro fastener is closed. Due to manufacturing tolerances and variations in the Velcro fasteners it can be difficult in practice to guarantee that once the fastener is closed the printed circuit board will always be located at a precise, distance from the windshield. The resilient contact elements, however, allow to compensate for such variations so a reliable contact with the antenna device can be easily achieved.

While the resilient contact elements have been described for use with a signal processing circuit they can also be used in a variety of other devices where an electrical connection needs to be made between two parts.

The above description of the invention should not be interpreted in any limiting manner since variations and refinements of the preferred embodiment are possible without departing from the spirit of the invention. The scope of the invention is defined in the appended claims and their equivalents.

What is claimed is:

1. A thin-film, laminated antenna device for sensing radio frequency signals, said antenna device comprising:

a first layer including an electrically conductive pathway;

a second layer of dielectric material overlaying said first layer;

said electrically conductive pathway including at least one exposed terminal for electrical connection with a signal processing device;

said second layer of dielectric material including a void area coinciding with said electrically conductive pathway, said exposed terminal traversing said void area and establishing electrical contact with said electrically conductive pathway through said void area;

said antenna device including a face capable of being bonded to a supporting surface; and said first and second layers being flexible to allow conformation of said antenna device against a curved supporting surface to which said antenna device may be mounted.

2. A thin-film, laminated antenna device as defined in claim 1, wherein said electrically conductive pathway has two end portions in a spaced apart relationship with one another, said exposed terminal being located at an intermediate position between said end portions.

3. A thin-film, laminated antenna device as defined in claim 2, including an electrically isolating substrate on which said electrically conductive pathway is mounted.

4. A thin-film, laminated antenna device as defined in claim 3, wherein a face of said substrate constitutes said face capable of being bonded to a supporting surface.

5. A thin-film, laminated antenna device as defined in claim 4, wherein said electrically conductive pathway in laid on the face of said substrate that is capable of being bonded to a supporting surface.

6. A thin-film, laminated antenna device as defined in claim 5, wherein the face of said substrate that is capable of being bonded to the supporting surface includes a layer of adhesive.

7. A thin-film, laminated antenna device as defined in claim 6, wherein said layer of adhesive is covered by a protective layer peelable to expose said layer of adhesive.

8. A thin-film, laminated antenna device as defined in claim 3, wherein said substrate, said electrically conductive pathway and said layer of dielectric material are capable of flexing within a range suitable to conform said antenna device to windshield, substantially without sustaining mechanical and electrical degradation.

9. A thin-film, laminated antenna device as defined in claim 8, wherein said electrically conductive pathway is mounted on said substrate by screen printing.

10. A thin-film, laminated antenna device as defined in claim 9, wherein said electrically conductive pathway incorporates a passive electrical component.

11. A thin-film, laminated antenna device as defined in claim 10, wherein said passive electrical component is selected from the group consisting of capacitor, inductor and resistor.

12. A. thin-film, laminated antenna device as defined in claim 11, wherein said passive electrical component is a capacitor, said capacitor including a first and second plates, one said plate overlaying the other said plate, said capacitor further including a dielectric medium between said plates.

13. A thin-film, laminated antenna device as defined in claim 11, wherein said passive electrical component is an inductor, said electrically conductive pathway including an undulating section that is capable of building-up a magnetic field during a passage of electrical current therethrough.

14. A thin-film, laminated antenna device as defined in claim 10, wherein said electrically conductive pathway includes a pair of undulating sections proximal to one another to establish a magnetic coupling between said pair of undulating sections.

15. A thin-film, laminated antenna device as defined in claim 3, wherein said substrate is substantially transparent.

16. A thin-film, laminated antenna device as defined in claim 3, wherein said substrate is made ot polyester.

17. A thin-film, laminated antenna device as defined in claim 1, wherein said antenna device is a dipole antenna.

18. A thin-film, laminated antenna device as defined in claim 1, wherein said electrically conductive pathway includes silver particles.

19. A thin-film, laminated antenna device as defined in claim 1, wherein said exposed terminal includes carbon particles.

* * * * *

UNITED STATES PATENT AND TRADEMARK OFFICE

CERTIFICATE OF CORRECTION

PATENT NO: 6,087,996

DATED: July 11, 2000

INVENTOR(S): Normand DERY

It is certified that error appears in the above-identified patent and that said Letters Patent is hereby corrected as shown below:

In Claim 5; column, 13 line 34: the word "in" after "conductive pathway" should be "is".

In Claim 16: column 14, line 35: the word "ot" after "made" should be "of".

Signed and Sealed this

First Day of May, 2001

*Attest:*

Nicholas P. Godici

NICHOLAS P. GODICI

*Attesting Officer*

*Acting Director of the United States Patent and Trademark Office*